US005557054A

United States Patent [19]

Shigenaga

[11] Patent Number: 5,557,054

[45] Date of Patent: Sep. 17, 1996

[54] FOOT PEDAL FOR A DRUM

[75] Inventor: Fumihiro Shigenaga, Hamamatsu, Japan

[73] Assignee: Yamaha Corporation, Shizuoka-ken, Japan

[21] Appl. No.: 461,204

[22] Filed: Jun. 5, 1995

[30] Foreign Application Priority Data

Nov. 15, 1994 [JP] Japan ..... 6-280383

[51] Int. Cl.[6] ..... G10D 13/02

[52] U.S. Cl. ..... 84/422.1

[58] Field of Search ..... 84/422.1

[56] References Cited

U.S. PATENT DOCUMENTS 3,967,523 7/1976 Currier et al. ..... 84/422 R

FOREIGN PATENT DOCUMENTS 58-43035 9/1983 Japan ..... G10D 13/02

*Primary Examiner*—Patrick J. Stanzione

*Attorney, Agent, or Firm*—Koda and Androlia

[57] ABSTRACT

A foot pedal for a drum including a frame main body, a heel piece, and a pedal plate installed between the frame main body and the heel piece. The frame main body is provided with a beater that makes a pivotal motion to beat a drum particularly a bass drum head when the pedal plate is depressed by the player. A connecting board which is to be placed on the floor is installed between the frame main body and the heel piece so that the frame main body is connected to the front end of the connecting board in a horizontally rotatable fashion. Thus, the frame main body is rotated to be set in any desired direction so as to comply with the orientation of the drum head, allowing the beater to strike the drum head at right angles.

5 Claims, 7 Drawing Sheets

FOOT PEDAL FOR A DRUM

BACKGROUND OF THE INVENTION

1. Field of the Invention

The present invention relates to a foot pedal for a drum in which the drum head of a bass drum is struck when the foot pedal is depressed with the foot and more particularly to a foot pedal for a drum which is designed so that the degree of freedom in setting and playing the drum set can be increased.

2. Prior Art

Various drum foot pedals of this type, in which a beater is caused to pivot by the depression of a foot board so that the beater strikes the drum head of a bass drum, have been proposed in the past (examples: Japanese Utility Model Application Publication No. 58-43035, etc.).

FIGS. 9 and 10 are a perspective view and a schematic plan view which illustrate a conventional example of a foot pedal for a drum. This conventional foot pedal may be described briefly as follows: The drum foot pedal 1 includes a pedal frame 2 which is set on the floor surface, and this pedal frame 2 is made up of a frame main body 2A, a pair of supporting columns (left and right) 2B which are installed in upright positions on the upper surface of the frame main body 2A, and a heel 2C which is connected to the frame main body 2A via a connecting member 3, etc. A clamping member 6 which holds the tightening frame (or hoop) 5 of a bass drum 4 is mounted to the frame main body 2A. A rotatable shaft 7 is installed between the upper ends of the pair of supporting columns 2B, 2B via bearings, and a rocker 8 is attached to the center of this rotatable shaft 7. A beater 9 which strikes the drum head of the bass drum 4 is installed on the rocker 8 via a beater rod 10, and one end of a pedal depressing force transmission member 12 which transmits the depressing force of a foot board 11 to the beater 9 is connected to the rocker 8. A timing belt, a flexible leather or plastic band or a chain, etc. can be used as the pedal depressing force transmission member 12. The foot board 11 is formed as a flat plate of sufficient size to accommodate the foot. The front end of the foot board 11 is connected to the other end of the pedal depressing force transmission member 12, and the rear end of the foot board 11 is connected to the heel 2C so that the foot board 11 is free to pivot upward and downward. Furthermore, the upper end of a return spring 13 (omitted in FIG. 2) which imparts a pivoting habit to the foot board 11 in the return direction is connected to one end of the rotatable shaft 7 via a cam plate 14, and the lower end of this return spring 13 is connected to a spring receiving member 15 which is installed on the lower end of one of the supporting columns 2B.

Furthermore, 16 indicates lugs, 17 indicates tightening bolts, and 18 indicates clasps.

In the drum foot pedal 1 constructed as described above, normally the foot board 11 is maintained at a prescribed inclination with the front end lifted as shown in FIG. 9 by the spring force of the return spring 13. When a depressing force is applied to the foot board 11 in this state, the pedal depressing force transmission member 12 is pulled down, and the beater 9 pivots by the rotatable shaft 7 and strikes the drum head of the bass drum 4. The maximum angle of depression of the foot board 11 in this case is approximately 15°. When the depressing force is removed from the foot board 11 after the beater 9 has struck the drum head, the foot board 11 is caused to pivot upward by the spring force of the return spring 13, and the foot board 11 returns to its initial position.

However, all conventional drum foot pedals 1 are set to face the corresponding bass drum 4 and are directly and securely connected thereto. Accordingly, the orientation of the player with respect to the bass drum 4, i. e., the setting angle of the bass drum 4, is restricted. If the orientation or setting angle is thus poor, playing with the foot firmly placed on the foot board 11 becomes impossible. Thus, there is only a slight degree of freedom in the setting or playing of the drum set. In actual playing, the drums are sometimes played with the foot oriented at such an angle that the foot protrudes from the foot board 11. In such cases, however, a large transmission loss in the pedal depressing force occurs, so that an excessively large depressing force is required.

Furthermore, since the foot board 11 protrudes toward the player from the lower central part of the drum head, the foot board 11 may be a nuisance when the drums are set up.

SUMMARY OF THE INVENTION

Accordingly, the present invention is devised in light of the conventional problems as described above. The object of the present invention is to provide a foot pedal for a drum which is designed so that the foot board and/or the bass drum can be set at the easiest angle for playing by the drummer, the degree of freedom in setting and playing the drum can be increased, and the foot board is not a nuisance at the time of drum setting.

In order to achieve the object, the invention is characterized in that in a foot pedal for a drum that includes a beater which is caused to pivot and strike the drum head by the depression of a foot board installed in a pedal frame, the foot board is provided in a rotatable fashion in the horizontal direction.

The invention is characterized in that in a foot pedal for a drum that includes a beater which is caused to pivot and strike the drum head by the depression of a foot board installed in a pedal frame, a connecting plate is provided underneath the foot board such that one end of the connecting plate is connected to the main body of the pedal frame in a rotatable fashion in the left and right directions, and the other end of the connecting plate is connected to the heel of the pedal frame.

The invention is characterized in that in the foot pedal, one end of a pedal depressing force transmission member which transmits the depressing force of the foot board to the beater is connected to the foot board via an anti-twisting mechanism.

The invention is characterized in that in the foot pedal, the anti-twisting mechanism is a rotating plate which is rotatably attached to the foot board, and one end of the pedal depressing force transmission member is connected to this rotating plate.

In the invention the foot board can be rotated together with the connecting plate in the left-right direction with respect to the pedal frame. Accordingly, the foot board can be set at an angle which allows easy playing by the drummer. Furthermore, the connecting plate and the pedal frame main body fastened to the bass drum are rotatable relative to each other. Accordingly, the setting angle of the drum with respect to the foot board can be altered by causing the pedal frame main body to rotate with respect to the connecting plate.

In the invention described in claims 3 and 4, the anti-twisting mechanism prevents the pedal depressing force transmission member from being twisted when the setting angle of the foot board or drum set is altered to an angle which allows easy playing by the drummer. Accordingly, the depressing force of the foot board is securely transmitted to the beater, and breaking, etc. of the pedal depressing force transmission member is prevented.

BRIEF DESCRIPTION OF THE INVENTION

DETAILED DESCRIPTION OF THE INVENTION

Below, the present invention will be described in detail in terms of an embodiment which is illustrated in the accompanying drawings.

Figure 1:
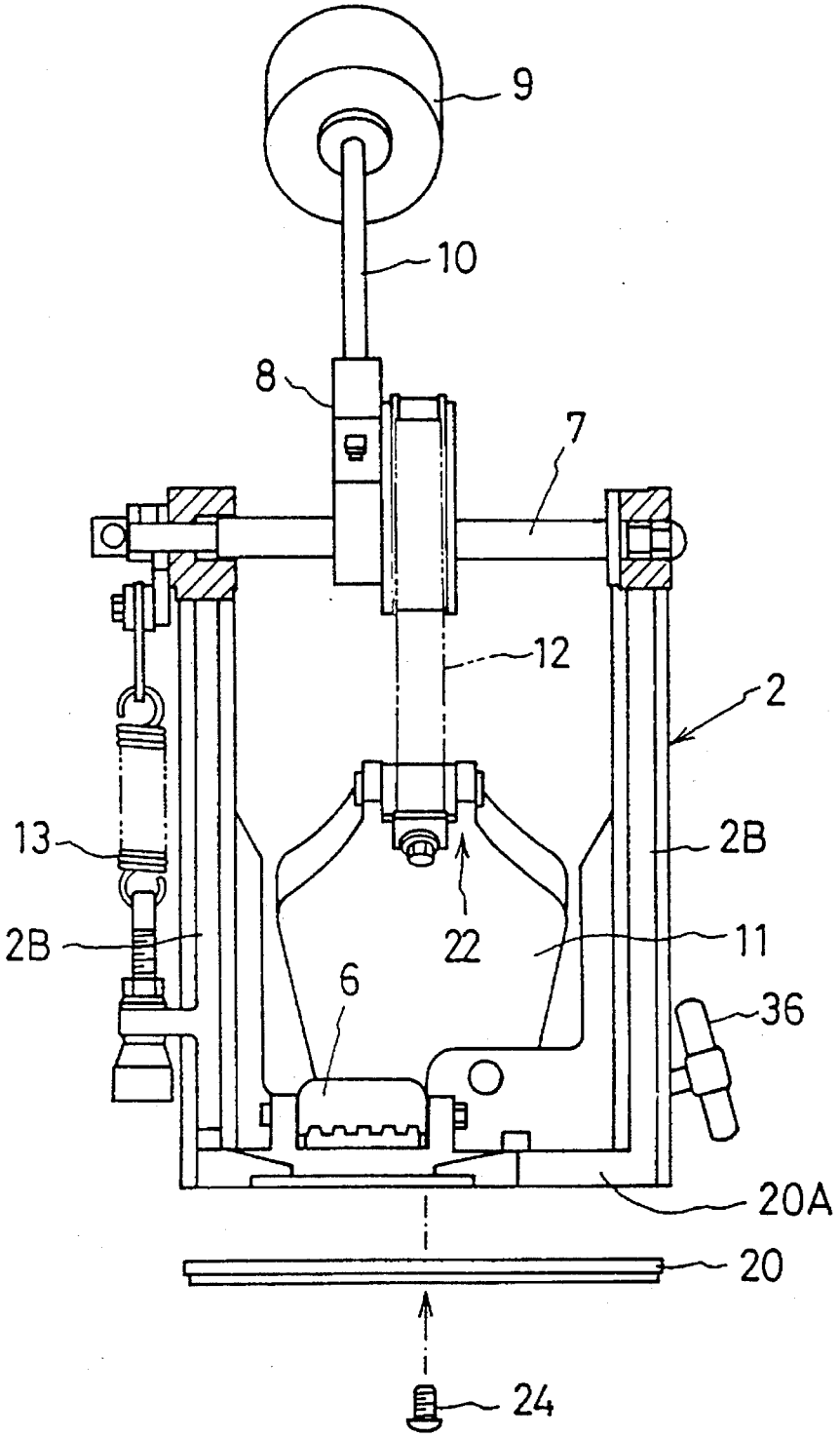
FIG. 1 is an exploded front view of one embodiment of the drum foot pedal of the present invention.
Figure 2:
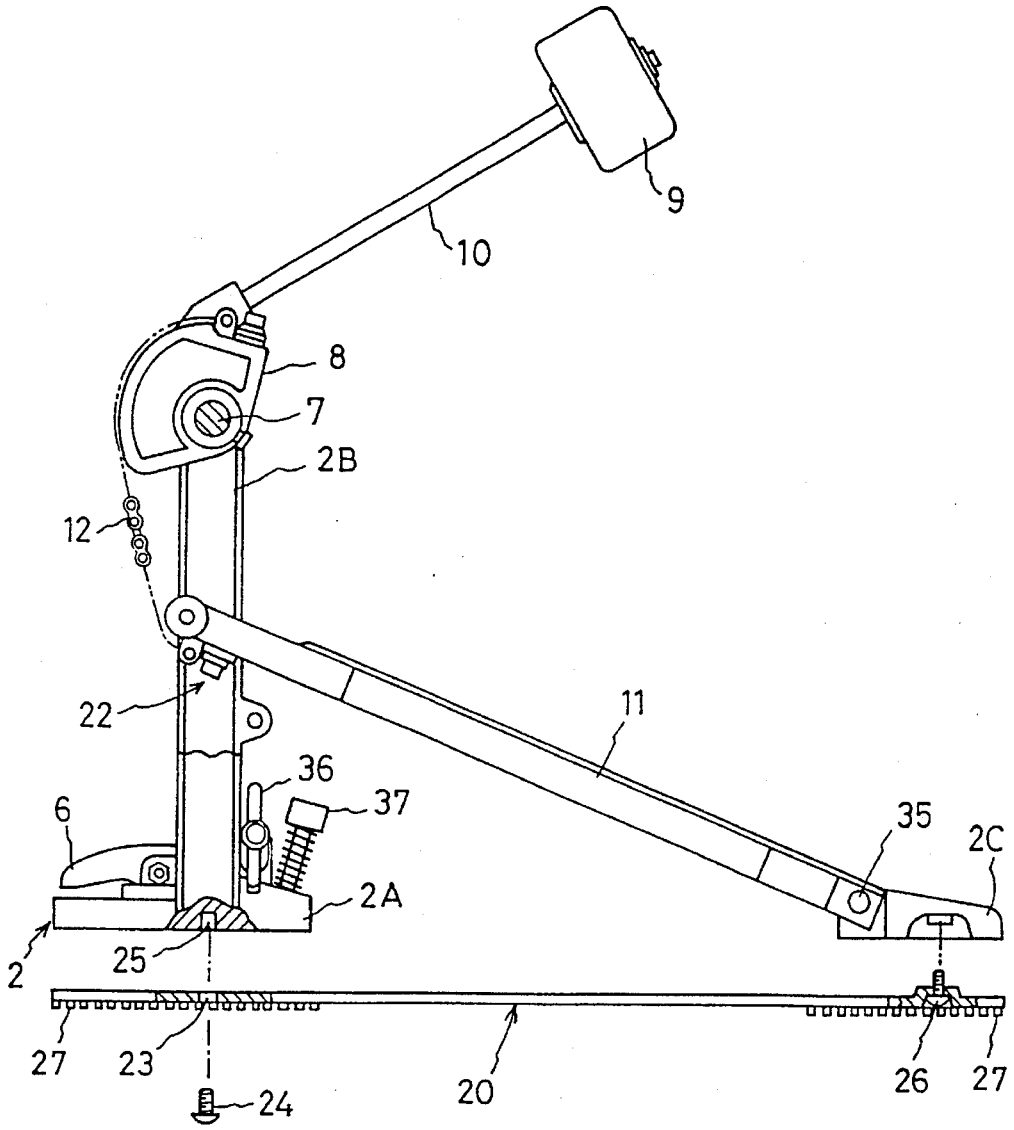
FIG. 2 is an exploded sectional side view of the same pedal.
Figure 3:
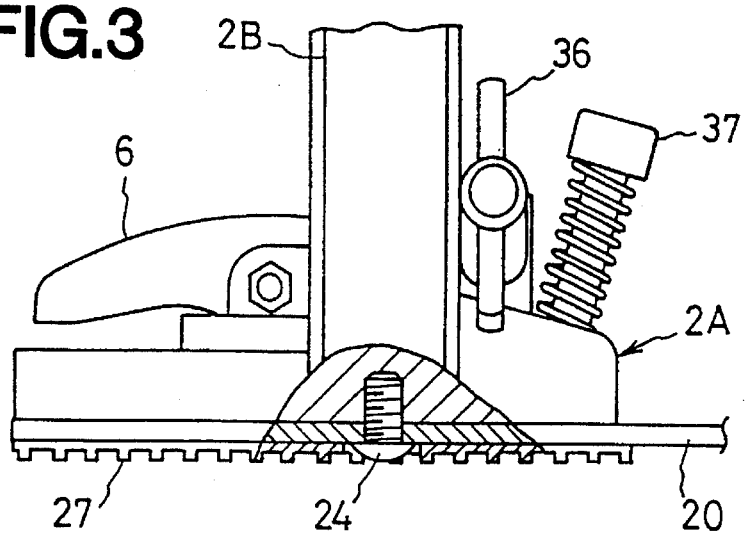
FIG. 3 is a partially sectional side view of the essential portion.
Figure 4:
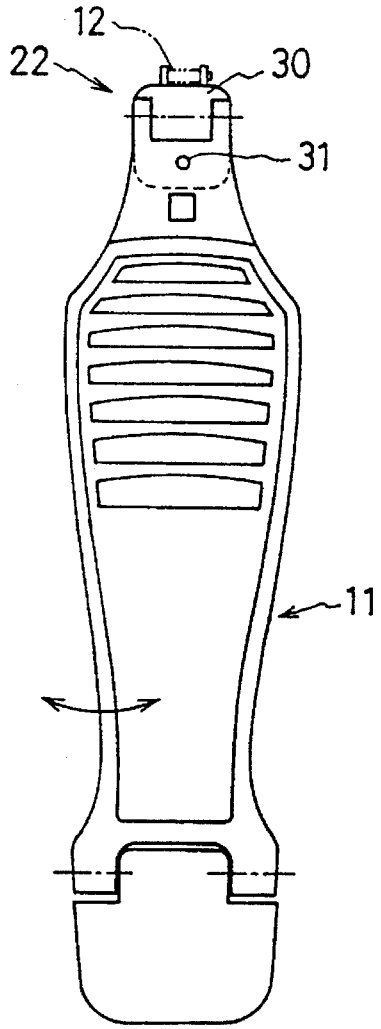
FIG. 4 is a top view of the foot board.
Figure 5:
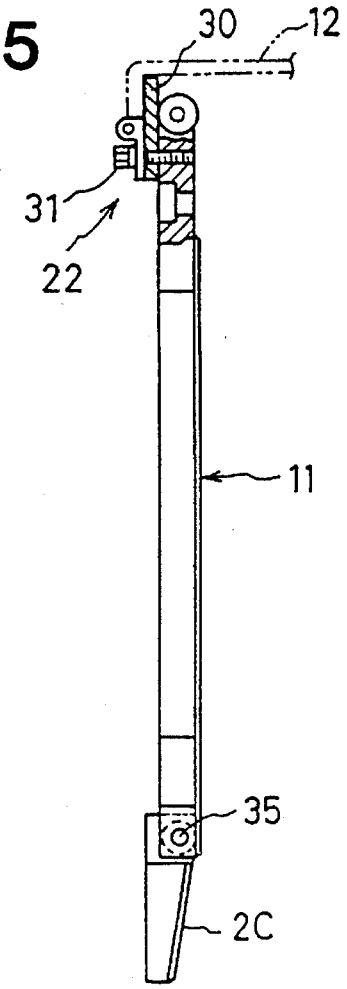
FIG. 5 is a partially sectional side view of the same foot board.
Figure 6:
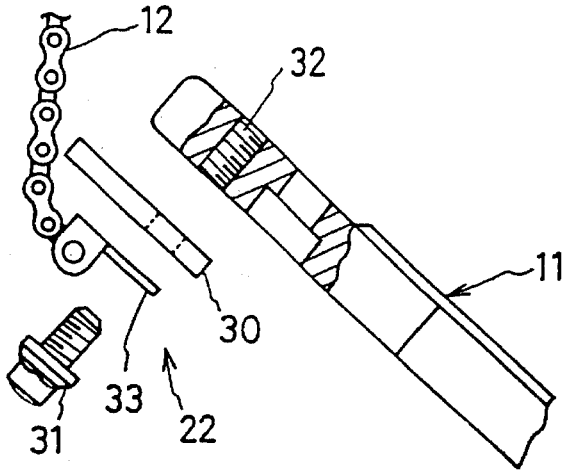
FIG. 6 is an exploded view of the anti-twisting mechanism.
Figure 9:
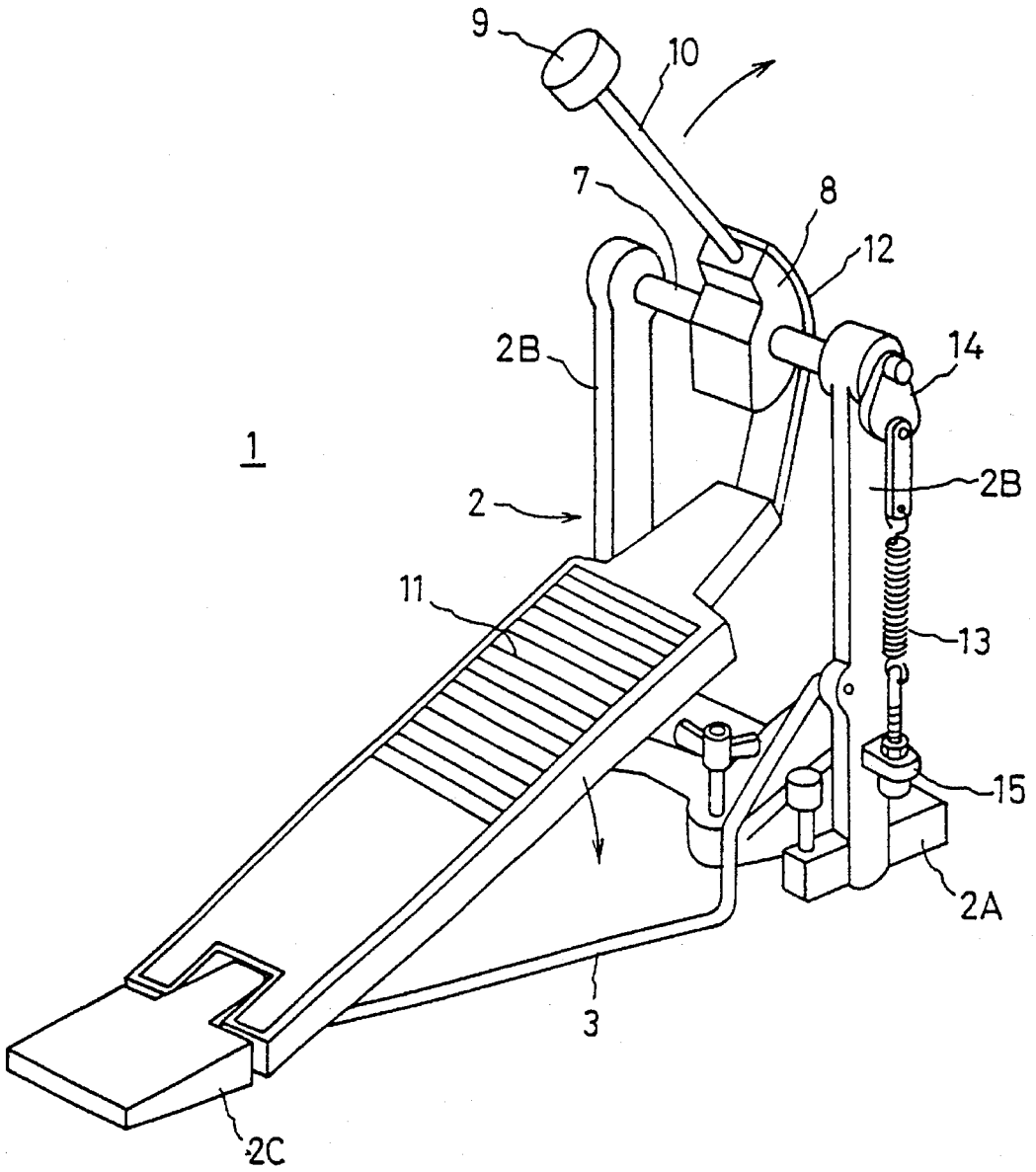
FIG.9 PRIOR ART
FIG. 9 is a perspective view of a conventional example of a drum foot pedal.
Figure 10:
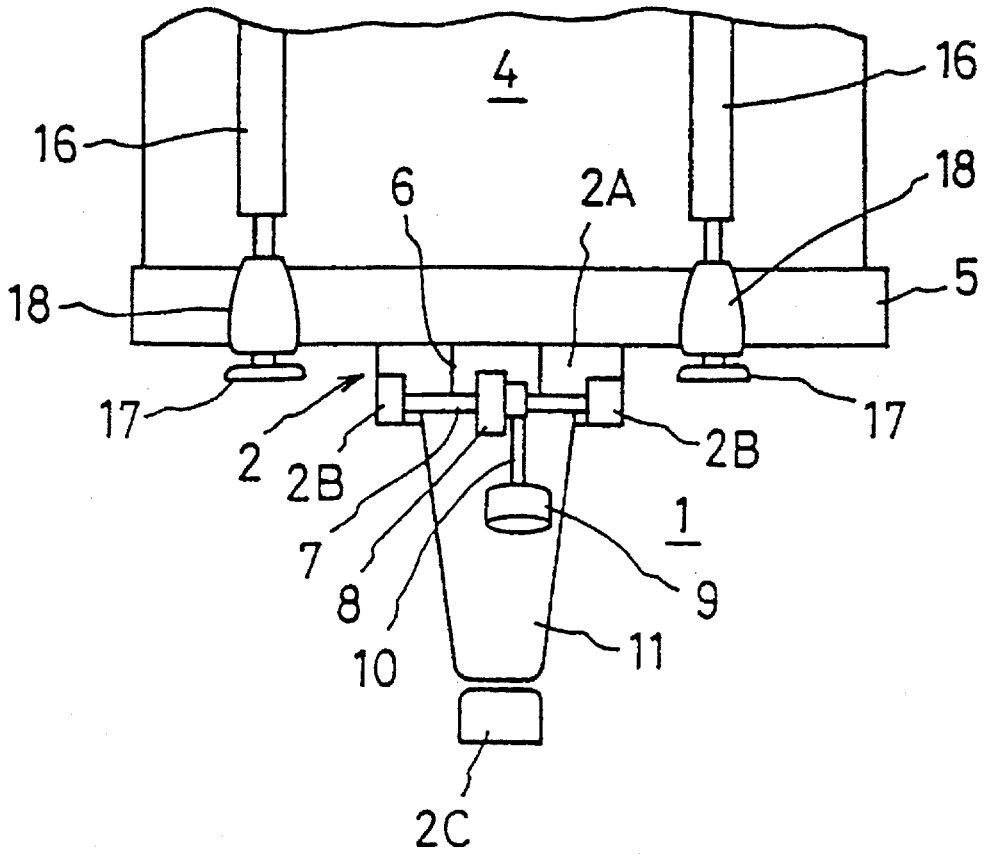
FIG. 10 PRIOR ART
FIG. 10 is a schematic top view of the same foot pedal.

FIGS. 1 through 6 illustrate one embodiment of the drum foot pedal of the present invention. FIG. 1 is an exploded front view of the foot pedal. FIG. 2 is an exploded sectional side view of the same. FIG. 3 is a partially sectional side view of the essential portion. FIG. 4 is a top view of the foot board. FIG. 5 is a partially sectional side view of the foot board. FIG. 6 is an exploded view of the anti-twisting mechanism. In these figures, constituent components which are the same as in FIGS. 9 and 10 are indicated by the same symbols, and a description of the parts is omitted. In the embodiment illustrated in the figures, a connecting plate 20 is installed underneath the pedal frame 2, the frame main body 2A is rotatably provided on the upper surface of the front end portion of this connecting plate 20, and the heel 2C is fastened to the upper surface of the rear end portion of the connecting plate 20. Furthermore, the pedal depressing force transmission member 12 is connected to the front end of the foot board 11 via an anti-twisting mechanism 22. A screw attachment hole 23 is formed in the front end portion of the connecting plate 20 so that the hole 23 is, width-wise, at the center of the front end portion of the plate 20; and a screw 24 is inserted into this screw attachment hole 23 from beneath and screwed into a screw hole 25 formed in the center of the undersurface of the frame main body 2A. Thus, the screw 24 is a shaft about which the frame main body 2A rotates. The heel 2C is firmly fastened to the upper surface of the rear end portion of the connecting plate 20 by means of a plurality of screws 26. Accordingly, when the connecting plate 20 is rotated about the screw 24, the foot board 11 is rotated together with the connecting plate 20, and the rear end (or the heel end) of the foot board 11 is caused to swing to the left and right. A plurality of projections 27 which prevent slipping are provided on the undersurface of the front and rear end portions of the connecting plate 20. The projections 27 are appropriately spaced in the direction of length of the connecting plate 20.

The anti-twisting mechanism 22 includes a rotating plate 30 which is installed on the undersurface of the foot board 11 so that the rotating plate 30 is rotatable by means of a bolt 31 which is screwed into a screw hole 32 formed in the undersurface of the front end portion of the foot board 11. Furthermore, a fastener 33 which is set on the lower end of the pedal depressing force transmission member 12 is fastened to the undersurface of the rotating plate 30 by means of the bolt 31. In this embodiment, a chain is used as the pedal depressing force transmission member 12, but the invention is not limited to the chain; and it goes without saying that it is possible to use a leather or plastic belt or a timing belt, etc. The rear end of the foot board 11 is connected to the heel 2C via a rotatable shaft 35 so that the foot board 11 is free to pivot upward and downward.

In FIG. 3, 36 indicates a fastening screw which presses the clamping member 6 against the hoop, and 37 indicates an anchor screw which prevents the drum foot pedal 1 and the bass drum from moving due to the shock that occurs when the foot board 11 is depressed.

Figure 7:
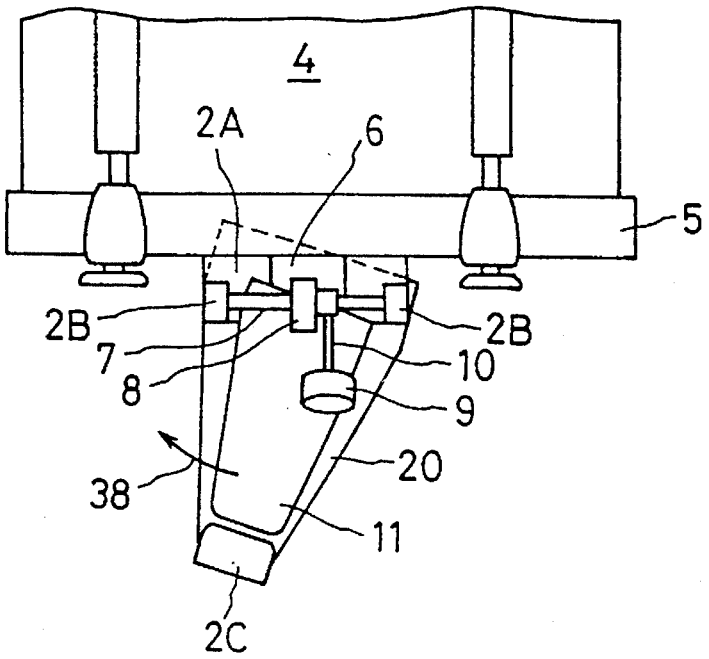
FIG. 7 is a top view of the altered orientation of the foot board.

In the drum foot pedal 1 constructed as described above, the orientation of the foot board 11 with respect to the bass drum can be freely adjusted. More specifically, since the frame main body 2A and the connecting plate 20 are provided so as to be rotatable relative to each other, when the connecting plate 20 is rotated in one direction, which is shown in FIG. 7 by the arrow 38, with the frame main body 2A fastened to the hoop of the bass drum via the clamping member 6, the foot board 11 is also rotated together with the connecting plate 20, thus allowing the foot board 11 to be set at an oblique angle with respect to the bass drum 4. In this case, since the frame main body 2A is fastened to the hoop 5 of the bass drum 4 so that the frame main body 2A faces the drum head, the beater 9 is not hindered to correctly strike the drum head when the foot board 11 is depressed.

Figure 8:
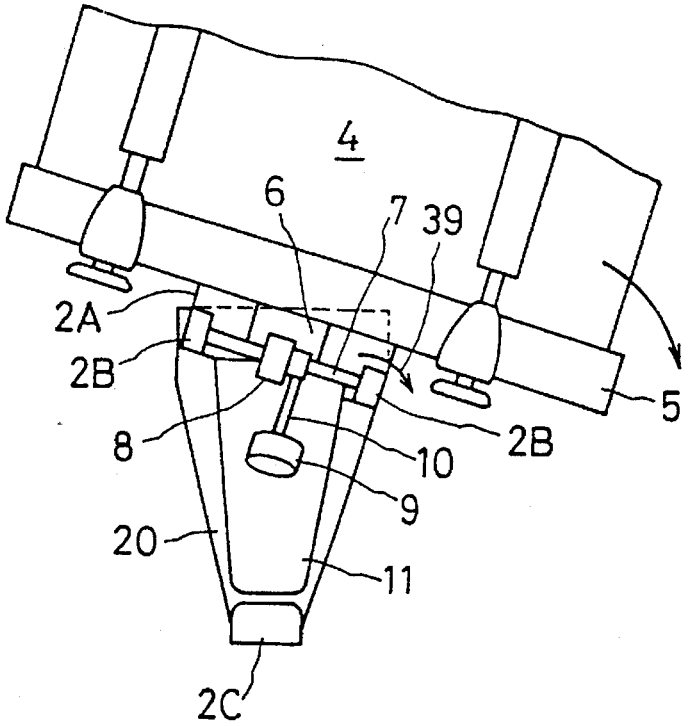
FIG. 8 is a top view of the altered setting angle of the bass drum.

Furthermore, when the frame main body 2A is rotated in the direction indicated by the arrow 39 in FIG. 8 with respect to the foot board 11 without altering the orientation of the foot board 11 itself, the bass drum 4 is rotated in the same direction, and the setting angle of the bass drum 4 is adjusted.

Here, when the orientation of the foot board 11 or the bass drum 4 is changed, the connected end portions of the pedal depressing force transmission member 12 and foot board 11 would become twisted, disallowing proper transmission of the depressing force. In the present invention, however, since the foot board 11 and the pedal depressing force transmission member 12 are connected together with the anti-twisting mechanism 22, even if the foot board 11 is rotated so as to change the orientation of the foot board 11, the rotating plate 30 itself is not rotated, and the pedal depressing force transmission member 12 is not twisted. Accordingly, the depressing force of the foot board 11 can be securely transmitted to the beater 9. If a band, a timing belt, etc. is used as the pedal depressing force transmission member 12, the breaking of such a band, timing belt, etc. are prevented.

In the above embodiment, the present invention is applied to the drum foot pedal 1 which includes the pedal frame 2 having a pair of left and right supporting columns 2B. However, the present invention is not limited to this arrangement. The number of supporting columns is optional, and it goes without saying that the present invention is applicable to and practiced with a drum foot pedal which includes a pedal frame having either a single supporting column or more than two supporting columns.

As describe above, in the drum foot pedals of the invention the foot board is provided on the pedal frame in such a manner that the foot board can be rotated towards the left and right. Accordingly, the setting angle of the drum set or the orientation of the foot board with respect to the bass drum can be freely altered. Consequently, the drummer can set the orientation of his body and foot at an orientation which is optimal for easy playing, so that the degree of freedom in playing can be increased. Furthermore, if the foot board is set by swinging it to the left and right, the foot board will not be a nuisance during the set up of the drums. Thus, the set-up of the drum can be accomplished easily.

Furthermore, in the drum foot pedals of the invention the foot board and the pedal depressing force transmission member which transmits the depressing force of the foot board to the beater are connected by an anti-twisting mechanism. Accordingly, even if the orientation of the foot board or the setting angle of the drum is changed, twisting of the pedal depressing force transmission member is prevented, and the depressing force of the foot pedal can be assuredly transmitted to the beater. Thus, since no twisting occurs, breakage of the pedal depressing force transmission member can be prevented.

I claim:

1. A foot pedal for a drum characterized in that in a foot pedal for a drum having a beater which is caused to pivot and strike the drum head by the depression of a foot board installed in a pedal frame, a connecting plate is provided underneath the foot board, one end of the connecting plate being connected to a main body of the pedal frame so that the connecting plate is rotatable in the left-right direction, and another end of the connecting plate being connected to a heel of the pedal frame.

2. A foot pedal for a drum according to claim 1 characterized in that one end of a pedal depressing force transmission member which transmits the depressing force of the foot board to the beater is connected to the foot board via an anti-twisting mechanism.

3. A foot pedal for a drum according to claim 2 characterized in that the anti-twisting mechanism comprises a rotating plate which is installed so as to be rotated with respect to the foot board, and one end of the pedal depressing force transmission member is connected to this rotating plate.

4. A foot pedal for a drum having a beater which is caused to pivot and strike the drum head by the compression of a foot pedal installed in a pedal frame, said foot pedal characterized in that the foot board is installed so as to be rotated in a horizontal direction and one end of a pedal depressing force transmission member which transmits the depressing force of the foot board to the beater is connected to the foot board via an anti-twisting mechanism.

5. A foot pedal for a drum according to claim 4, further characterized in that the anti-twisting mechanism comprises a rotating plate which is installed so as to be rotated with respect to the foot board, and one end of the pedal depressing force transmission member is connected to this rotating plate.

* * * * *